United States Patent [19]

Laleta-Ballini

[11] 4,220,086

[45] Sep. 2, 1980

[54] LITHOGRAPHIC PRINTING PROCESS

[75] Inventor: Jean M. Laleta-Ballini, Paris, France

[73] Assignee: Idegraf, Geneva, Switzerland

[21] Appl. No.: 914,198

[22] Filed: Jun. 12, 1978

Related U.S. Application Data

[63] Continuation of Ser. No. 762,878, Jan. 27, 1977, abandoned.

[51] Int. Cl.[3] ..... B41M 1/06; B05D 1/36

[52] U.S. Cl. ..... 101/450.1; 101/468; 427/258

[58] Field of Search ..... 101/450–457, 101/460–463, 467, 468, 470, 471; 427/258

[56] References Cited

U.S. PATENT DOCUMENTS

| | | | |
|---|---|---|---|
| 152,717 | 6/1874 | Wogram | 427/258 |
| 233,787 | 10/1880 | McCaw | 427/258 |
| 741,763 | 10/1903 | Brown | 427/258 |
| 1,585,765 | 5/1926 | Chitra | 427/258 |
| 1,669,416 | 5/1928 | Huebner | 101/456 |
| 1,888,672 | 11/1932 | Howard | 427/258 |
| 2,104,790 | 1/1938 | Casto | 427/258 |
| 2,602,072 | 7/1952 | Greubel | 427/258 |
| 2,696,168 | 12/1954 | Costello | 427/258 |
| 3,363,557 | 1/1968 | Blake | 101/473 |
| 3,667,983 | 6/1972 | Haggas | 427/258 |

FOREIGN PATENT DOCUMENTS

| | | | |
|---|---|---|---|
| 1943094 | 3/1971 | Fed. Rep. of Germany | 101/458 |
| 1211149 | 11/1970 | United Kingdom | 101/470 |

*Primary Examiner*—Clyde I. Coughenour
*Attorney, Agent, or Firm*—J. Harold Nissen

[57] ABSTRACT

A method of making a lithographic product having the printed characteristics of a lithographic product and having the visual characteristics of a product simulating an oil painting. The process includes the step of printing a pictorial representation onto a linen-type canvas material by means of a lithographic process having the artist sign the pictorial representation by hand, and then applying one or more layers of varnish to the linen-type canvas material having the artist signed pictorial representation printed thereon; and, a lithographic product having the visual characteristics simulating an oil painting which includes a linen-type canvas material with a pictorial representation printed thereon by a lithographic process, and a layer of varnish over the pictorial representation.

3 Claims, No Drawings

LITHOGRAPHIC PRINTING PROCESS

This is a continuation of application Ser. No. 762,878, filed Jan. 27, 1977 now abandoned.

The present invention has for its object the use of a novel support for the application of a lithographic printing process.

Since the invention of lithography, at the end of the eighteenth century, the only support used for this reproduction process is paper.

Original lithographic art, which has regained favor in the past few years, has, itself, always been effected on paper. Lithographies thus created have a well-known characteristic and a particular presentation since they always comprise engraved or embossed borders. They are generally of limited edition with each example being numbered and signed by the artist in the lower margin and with pencil.

The inventor has found that, contrary to all accepted ideas, linen for painting, commonly used by artists, constitutes an excellent support for lithographic printing in black or in colors, and that this support can be treated without any difficulty by commonly used lithographic presses.

As used herein, linen for painting, commonly used by artists, is intended to convey a meaning different from the meaning of "paper". Paper is the conventional material for the well known lithographic process.

Linen for painting is the type of canvas material which an artist would use for painting. Such material is distinguishable from paper because paper is not a stretchable material, whereas what is here intended is a stretchable material. It should also be noted that this invention employs linen-type canvas material as distinguished from the prior heretofore known paper for the lithographic process.

The linen thus printed can advantageously receive one or more layers of varnish, either in the course of printing, that is to say on the machine, or after, this varnish having a dual aim: to make the ink shine or glisten and to protect the printing from the harmful effects of the sun's rays.

The linen can then be mounted on a frame.

The novel product thus obtained presents an aspect very different from lithography on paper, much closer to an oil-painting on linen, while having a truly authentic and original character which color reproductions of works of art, which are produced by photographic means and which are not personally signed by the artist, do not have.

The term linen as used herein is intended to designate a firm closely woven cloth of plain weave which can be made in various weights. It is this type of material which is commonly used by artists and is adapted to receive an artist's painting. Moreover, it is this type of material which can be mounted on a frame and stretched, whereas paper is not mounted onto a frame, nor can paper used for the lithographic process be stretched.

Lithographies on linen due to their nature and because they are mounted on frames and are varnished do not require protection by glass.

I claim:

1. A method of making a lithographic product having the printed characteristics of a lithographic product and having the visual characteristics of a product simulating an oil painting on linen, comprising the steps of:

applying a pictorial representation to a support by a lithographic process, said support consisting of a linen material of the type commonly used by artists for making an oil painting, having the artist affix his signature to the linen material after the pictorial representation has been applied thereto by said lithographic process, applying at least one layer of varnish to said lithographic material after the pictorial representation has been applied thereto, said pictorial representation being applied by the lithographic process to said linen material which is a canvas-type linen, said varnish having the effect of protecting the pictorial representation from the harmful effect of the sun's rays and making the pictorial representation glisten, and affixing the linen material having the pictorial representation applied thereto to a carrier to stretch the linen material in the same manner as an oil painting.

2. The method as claimed in claim 1, including the step of:

applying an individual number to each lithograph.

3. The method as claimed in claim 1 or 2, wherein the carrier is a stretcher frame to stretch the linen material in the same manner as an oil painting.

* * * * *